United States Patent [19]

Stageberg

[11] 4,431,130

[45] Feb. 14, 1984

[54] NEEDLEWORK SCRAP RECEPTACLE

[76] Inventor: Wilfred E. Stageberg, 2215 Falcon Ave., St. Paul, Minn. 55119

[21] Appl. No.: 428,465

[22] Filed: Sep. 29, 1982

[51] Int. Cl.[3] ..... B65D 91/00

[52] U.S. Cl. ..... 232/43.1

[58] Field of Search ..... 220/69, 306; 232/43.1

[56] References Cited

U.S. PATENT DOCUMENTS 2,573,391 10/1951 Bonanos ..... 232/43.1

*Primary Examiner*—George T. Hall

*Attorney, Agent, or Firm*—William L. Huebsch

[57] ABSTRACT

A receptacle for needlework scrap comprising a hollow tubular body member having an upper end with an inwardly projecting lip through which scrap may be inserted into the receptacle and separated from the fingers against the lip; and a base releasably engaged with a bottom end of the body member that normally closes the bottom end, but can be removed so that compressed collected scrap may be pressed from within the receptacle out through the bottom end.

4 Claims, 4 Drawing Figures

NEEDLEWORK SCRAP RECEPTACLE

BACKGROUND OF THE INVENTION

The present invention is related to receptacles for scrap material, and in one important aspect, to receptacles for scrap resulting from needlework.

Collecting small bits of needlework scrap, such as are developed during needlework projects such as crewel, latch hook or needle point, presents peculiar problems. The low density and compressibility of such scrap material make it difficult to dispose of. Such scrap is too light to throw for any significant distance into a waste can. If such scrap material is placed in an open top container such as a can or cup positioned closely adjacent a person, it is difficult to separate the scrap from the fingers after the scrap is placed in the receptacle; and subsequently it is difficult to remove the compressed scrap from the container to dispose of it.

SUMMARY OF THE INVENTION

The present invention provides a receptacle for low density compressible needlework scrap which facilitates both manually placing the scrap in the receptacle and subsequently removing the compressed scrap from the receptacle.

According to the present invention there is provided a receptacle for needlework scrap comprising a hollow tubular body member, and a base adapted to releasably engage and close a bottom end of the body member and support the body member on a planar surface with an upper end of the body member projecting upwardly so that needlework scraps may be placed in the tube through its upper end. Once the receptacle is filled, it may be easily emptied by removing the base so that the debris may be pushed from within the tube through its lower end via pressure applied through its upper end.

Preferably the body member has an inwardly projecting lip adjacent its upper end which facilitates separating the debris from a depositor's finger tips. Also, preferably, the body member is frustoconical shape to further facilitate pressing the debris from within the body member after the base is removed due to its tapered inner diameter.

BRIEF DESCRIPTION OF DRAWING

The present invention will be further described with reference to the accompanying drawing wherein like numbers refer to like parts in the several views, and wherein.

DETAILED DESCRIPTION

Figure 1:
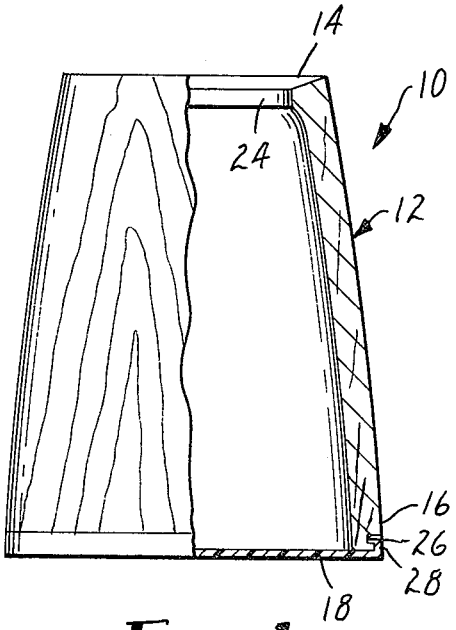
FIG. 1 is a vertical plan view, partially in section, of a first embodiment of a needlework scrap container according to the present invention.
Figure 2:
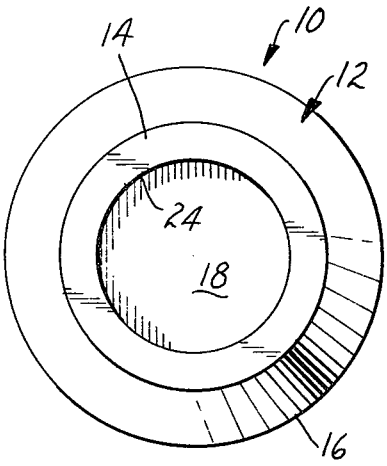
FIG. 2 is a top view of the container of FIG. 1.

Referring now to the drawing there is shown in FIG. 1 a first embodiment of a receptacle into which needlework scrap may be manually placed, generally designated by the reference numeral 10.

As can best be seen in FIG. 1, the receptacle 10 comprises a generally tubular frustoconical body member 12 tapered toward a top end 14 through which needlework scrap may be placed in the receptacle 10, and having an opposite bottom end 16; and a base 18 releasably attached across the bottom end 16 having an outer surface adapted to rest on a planar surface, and an opposite top surface adapted to support the bottom end 16 of the body member 12 and to extend across the opening through the body member 12 at the bottom end 16 to retain needlework scrap in the receptacle 10.

The body member 12 has an inwardly projecting lip 24 adjacent its top end, which lip 24 is adapted to help separate needlework scrap from the fingers of a person who inserts the scrap into the receptacle through the opening at the top end 14 of the body member 12.

The base 18 is releasably attached across the bottom end of the body member by means comprising a stepped groove 26 around the periphery of the body member adjacent its bottom end 16. The base 18 has a resiliently flexible flange 28 around its periphery and projecting above its top surface, which flange 28 includes an inwardly projecting ridge seated in an innermost part of the groove 26. The base 18 is formed of a resiliently flexible material so that the flange 26 may be resiliently deformed to separate or engage the body member 12 and base 18.

To use the scrap receptacle 10, a person can insert the scrap through the opening at the top end 14 of the body member 12, and use the inwardly projecting lip 24 to help separate or scrape the scrap from his or her fingers. After the receptacle 10 is sufficiently full that it is desired to empty the receptacle 10 into a larger container (such as a wastebasket), the user can pry off the base 18 with his fingers and push the scrap out through the bottom end 16 of the body member 12 by reaching through the top end 14. The base 18 is then replaced and the receptacle 10 is again ready for use.

Figure 4:
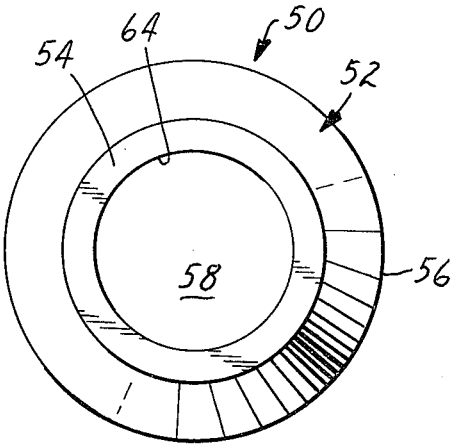
FIG. 4 is a top view of the container of FIG. 3.
Figure 3:
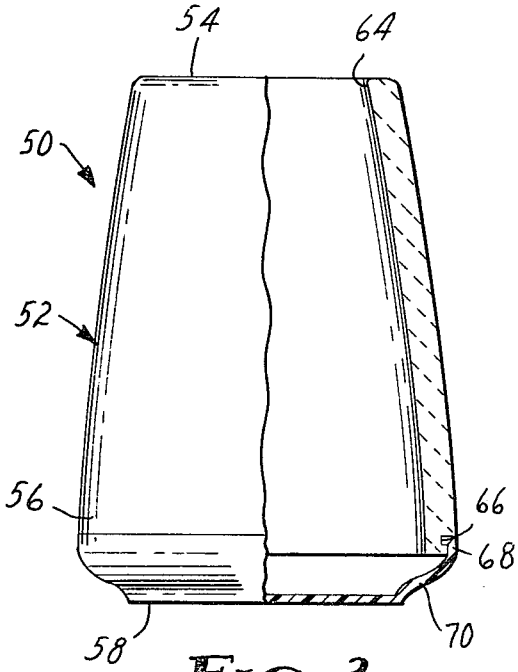
FIG. 3 is a vertical plan view, partially in section of a second embodiment of a needlework scrap container according to the present invention.

FIGS. 3 and 4 illustrate an alternate embodiment of a receptacle according to the present invention generally designated by the reference numeral 50.

As can best be seen in FIG. 3, the receptacle 50, like the receptacle 10, also comprises a generally tubular frustoconical body member 52 tapered toward a top end 54 through which needlework scrap may be placed in the receptacle 50, and having an opposite bottom end 56; and a base 58 releasably attached across the bottom end 56 having an outer surface adapted to rest on a planar surface, and an opposite top surface adapted to support the bottom end 56 of the body member 52 and to extend across the opening through the body member at the bottom end 56 to retain needlework scrap in the receptacle 50.

Also, the body member 52 has an inwardly projecting lip 64 adjacent its top end, which lip 64 is adapted to help separate needlework scrap from the fingers of a person who inserts the scrap into the receptacle 50 through the opening at the top end 54 of the body member 52.

The base 58 is releasably attached across the bottom end 56 of the body member 52 by means similar to the means that attach the base 58 across the bottom end 16 of the body member 12 of the receptacle 10, which means comprise a stepped groove 66 around the periphery of the body member adjacent its bottom end 56, and the base 58 has a resiliently flexible flange 68 around its periphery and projecting above its top surface, which flange 68 has an inwardly projecting ridge seated in the groove and is resiliently flexible so that the flange 68 may be resiliently deformed to separate or engage the body member 52 and base 58.

The main difference between the receptacles 10 and 50 is in the shapes of their bases 18 and 58 with the base 18 being generally flat except for the flange 28, and the base 58 having a flat central portion with an outwardly dished edge wall 70 that terminates at the flange 68.

The body member 12 or 52 of either receptacle 10 or 50 is preferably made of a rigid decorative material such as wood or ceramic material; whereas the base 18 or 58 is preferably made of a relatively soft pliable resiliently flexible polymeric material so that (1) the flange 28 or 68 can be moved into or out of engagement with the groove 26 or 66 in the body member 12 or 52, and so that the base 18 or 58 will not scratch the finish of furniture on which the receptacle 10 or 50 may be placed.

The present inention has now been described with reference to two preferred embodiments. It will be appreciated by those skilled in the art, however, that the shapes and means for engagement between the body member and the base of the present invention could be changed from those shown without departing from the spirit of the present invention. For example, the base and body member could be adapted for threaded engagement. Also other materials than those suggested could be used for both the body member and the base, such as a suitable rigid polymer. Thus the present invention should not be limited to the structures described in this specification, but only by the structure and means recited in the dependent claims and their equivalents.

I claim:

1. A receptacle for collecting needlework scrap, said receptacle comprising a generally tubular body member having a top end, a bottom end, and a through opening between said ends adapted to receive needlework debris inserted through the opening at said top end; and a base having an outer surface to rest on a planar surface, and an opposite top surface adapted to support the bottom end of said body member and to extend across said opening at said bottom end to retain needlework scrap in said opening;

said base and the bottom end of said tubular body including means in releasable engagement for normally retaining said base across said bottom end and for affording separation of said base and body to facilitate removal of debris from within said opening.

2. A receptacle according to claim 1 wherein said receptacle has an inwardly projecting lip adjacent said top end.

3. A receptacle according to claim 1 or claim 2 wherein said body is generally frustoconical and is tapered toward said top end.

4. A receptacle according to claim 1 or claim 2 wherein said means in releasable engagement between said body and said base comprises said body member having a groove around its periphery adjacent said bottom end, and said base having resilient flexible flange around its periphery projecting above said top surface, and having an inwardly projecting annular ridge seated in said groove, said flange and ridge being resiliently deformable to separate or engage said body member and base.

* * * * *